US006526904B2

(12) United States Patent
Liston et al.

(10) Patent No.: US 6,526,904 B2
(45) Date of Patent: Mar. 4, 2003

(54) SEMI-RIGID PONTOON

(76) Inventors: Kelton Liston, 142 S. 1000 East, Brigham City, UT (US) 84302; Carol Olson, 210 W. 900 North, Brigham City, UT (US) 84302; David Little, 5203 S. 2400 West, Wellsville, UT (US) 94339

( * ) Notice: Subject to any disclaimer, the term of this patent is extended or adjusted under 35 U.S.C. 154(b) by 0 days.

(21) Appl. No.: 09/920,254

(22) Filed: Aug. 1, 2001

(65) Prior Publication Data

US 2002/0073909 A1 Jun. 20, 2002

Related U.S. Application Data

(60) Provisional application No. 60/222,692, filed on Aug. 2, 2000.

(51) Int. Cl.[7] ..... B63B 7/00
(52) U.S. Cl. ..... 114/345; 114/61.25; 114/354
(58) Field of Search ..... 114/345, 354, 114/61.25

(56) References Cited

U.S. PATENT DOCUMENTS 3,761,979 A * 10/1973 Daughenbaugh ..... 441/38
3,812,805 A * 5/1974 Forssell et al. ..... 114/345
4,652,173 A * 3/1987 Kallestad ..... 405/69
5,174,232 A * 12/1992 Boddy ..... 114/345
5,279,248 A * 1/1994 Blachford ..... 114/347
5,413,066 A * 5/1995 Spencer et al. ..... 114/354
5,651,706 A * 7/1997 Kasper ..... 114/354
5,711,240 A * 1/1998 Baker ..... 114/345
5,878,688 A * 3/1999 Merrett et al. ..... 114/345
6,343,560 B1 * 2/2002 Myers ..... 114/61.25

* cited by examiner

*Primary Examiner*—S. Joseph Morano
*Assistant Examiner*—Lars A. Olson
(74) *Attorney, Agent, or Firm*—Thorpe North & Western, LLP

(57) ABSTRACT

A pontoon comprising a seamless, non-woven, one-piece, inflatable vessel preferably formed by a process of rotational molding, from a resilient, semi-rigid polyolefin elastomer, preferably metalocene. The pontoon has shape memory characteristics, which make it partially self-inflating, and cause it to entrap air when partially deflated, to thereby resist complete deflation if punctured, allowing a user to more easily get to safety. Punctures in the pontoon may be easily eliminated by applying heat to the polymer material at the site of the puncture, such as with a hot knife or other metal implement, so as to fuse the polymer material together. The bottom of the pontoon is preferably thicker than the top, and the ends of the pontoon taper to a blunt point that is thicker still, to thereby resist damage from impact and to help maintain the desirable shape-memory characteristics of the pontoon. The pontoon is tolerant of significant relative pressure changes without substantial deformation or change in its shape.

42 Claims, 2 Drawing Sheets

SEMI-RIGID PONTOON

CROSS REFERENCE TO RELATED APPLICATIONS

This application claims the benefit of U.S. Provisional Application No. 60/222,692 filed Aug. 2, 2000.

BACKGROUND OF THE INVENTION

1. Field of the Invention

This invention relates to floatation devices. More particularly, the present invention relates to a lightweight, resilient, seamless pontoon having shape memory characteristics which make it partially self-inflating, and resistant to deflation even when punctured.

2. State of the Art

Lightweight and portable flotation devices, including pontoon boats, float tubes, etc., have become increasingly popular in recent years, particularly with sport fishermen and white water enthusiasts. Most of these devices rely upon inflatable tubes, pontoon, or bladders which comprise a thin, flexible membrane which is filled with pressurized air. These prior art devices are very lightweight and easily portable, and may be folded into a relatively compact shape. Prior art pontoons which are formed of a thin membrane such as vinyl are typically 0.015 inch thick. Others, such as polyurethane film are even thinner, such as about 0.009 inch. Such pontoons are generally uniform in thickness throughout, and are frequently sewn together from several flat pieces to form the tubular shape.

However, because they are relatively thin, typical float tubes and pontoons are highly susceptible to puncture, such as from snagging fish hooks, rocks, branches, etc. Additionally, the materials of their construction are typically sewn together, creating seams that present inherent weakness. Because of their thinness and pliability, when typical pontoons are punctured, they usually entirely collapse and lose their buoyancy. They can also be difficult to repair. Typical thin membrane pontoons are repaired in a manner similar to bicycle or automobile tires, using patches and chemical adhesives. Once repaired, the membrane may not be as strong as it was before.

Additionally, typical float tubes and pontoons are very susceptible to changes in temperature and barometric pressure. For example, many users first inflate their boat in the morning, when temperatures are cool. Then, by afternoon, when the ambient temperature has increased, the pontoon pressure will have increased such that air must be released from the pontoon to prevent it from bursting. Then when the temperature drops again toward evening, the pontoon pressure likewise drops, and the boat often no longer provides sufficient buoyancy.

Similarly, many boat users inflate their pontoons before leaving home, then drive into a mountainous region at much higher altitude. In the course of gaining altitude, the barometric pressure drops, and the relative pressure inside the pontoons increases, sometimes enough to cause the pontoon to burst.

SUMMARY OF THE INVENTION

The present invention overcomes many of the problems of the prior art by providing a pontoon comprising a seamless, non-woven, one-piece, inflatable vessel preferably formed by rotational molding, from a resilient, semi-rigid polyolefin elastomer, preferably metalocene. The pontoon has shape memory characteristics which make it partially self-inflating, and cause it to entrap air when partially deflated, to thereby resist complete deflation if punctured, allowing a user to more easily get to safety. Punctures in the pontoon may be easily repaired by applying heat to the polymer material at the site of the puncture, such as with a hot knife or other metal item, so as to re-fuse the polymer material together. The bottom of the pontoon is preferably thicker than the top, and the ends of the pontoon taper to a blunt point that is thicker still, to thereby resist damage from impact and to help maintain the desirable shape-memory characteristics of the pontoon. The pontoon is also more tolerant of significant relative pressure changes than typical thin membrane inflatable pontoons, without substantial deformation or change in its shape.

Specifically, a hand portable inflatable boat for floating a person in water comprises a seat, positioned to support a person on the boat; and at least one float, positioned to support the seat above the water, having a cavity formed within the float, designed to hold air and a wall, formed around the cavity, that has a shape memory in a form of a fully inflated float. Alternatively, a hand portable inflatable pontoon boat for floating a person in water comprises a seamless, non-woven, one-piece, inflatable vessel of resilient, semi-rigid polyolefin elastomer, having a top, a bottom and two ends which taper to a blunt point that is thicker than other portions thereof; wherein the vessel is configured to retain a shape memory of an inflated configuration, so as to be partially self-inflating and configured to entrap air when partially deflated, to thereby resist complete deflation. Next, a self-inflating float for use with a pontoon boat comprises a seamless, non-woven shell defining a cavity, wherein the shell is biased to form an expanded shape when pressure is equalized between the cavity and the air surrounding the shell; and a valve configured for allowing air in and air out of the cavity.

Other advantages and features of the present invention will be apparent to those skilled in the art, based on the following description, taken in combination with the accompanying drawings.

BRIEF DESCRIPTION OF THE DRAWINGS

In the accompanying drawings which illustrate embodiments of the invention.

DETAILED DESCRIPTION OF THE PREFERRED EMBODIMENT

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
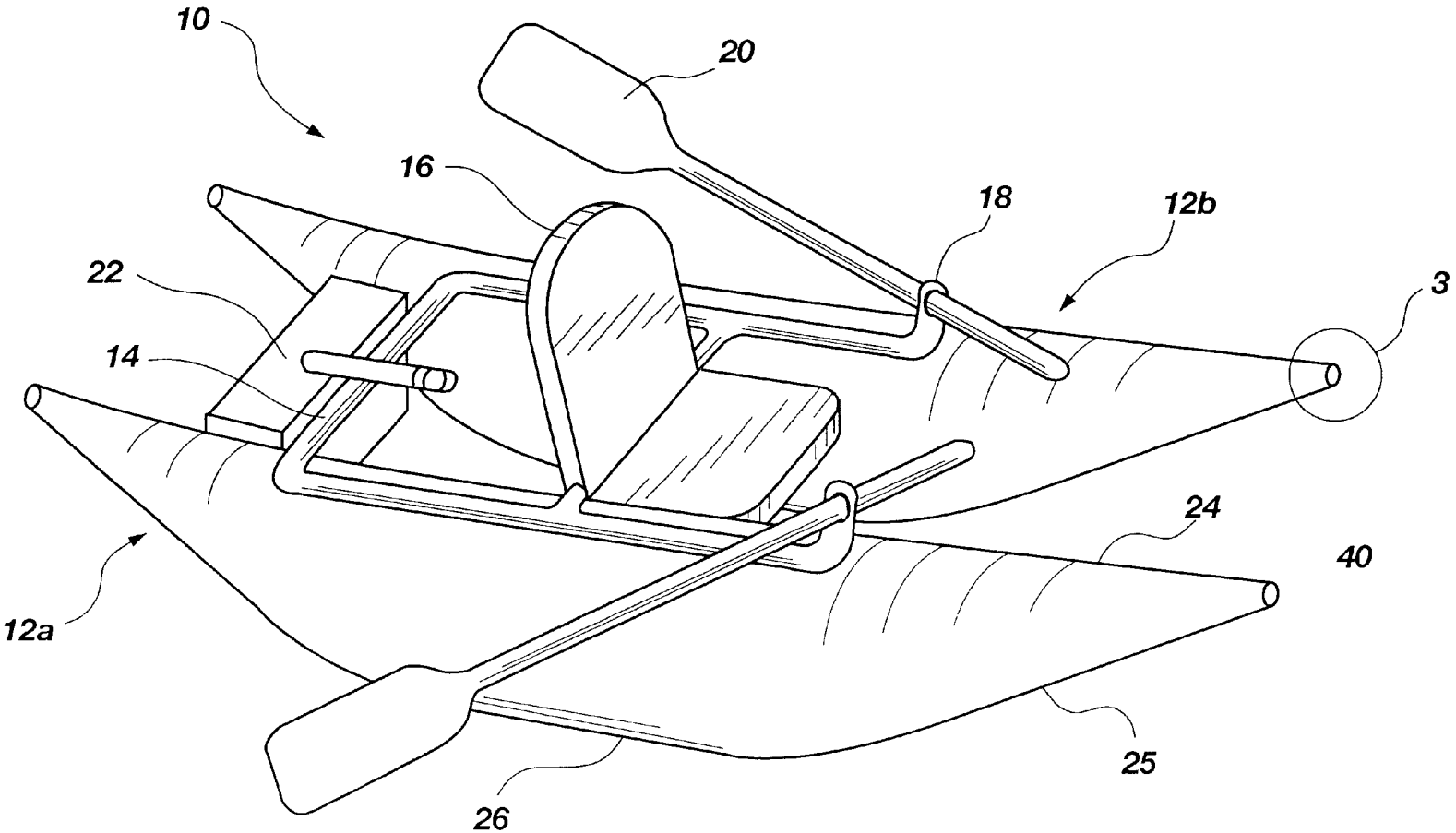
FIG. 1 is a pictorial view of a pontoon boat having pontoons according to the present invention.

Referring to FIG. 1, a typical pontoon boat 10 comprises a pair of inflated parallel pontoons 12*a* and 12*b*, also referred to as floats, having a top 24, sides 25, and a bottom 26. The pontoons are typically connected by a lightweight frame 14 having one or more seats 16 attached thereto. The frame typically includes oar locks 18 and oars 20 to allow a user seated in the seat 16 to paddle the boat. Some models also have small trolling motors 22 attached to the rearward portion of the frame 14.

The present preferred embodiment of the invention has pontoons 12 made of a seamless, one-piece vessel formed of a relatively thick, resilient polymer material, which has shape memory properties. One of the preferred material is a polyolefin elastomer made by Nu Plast, Inc., and commonly known as metalocene.

Figure 2:
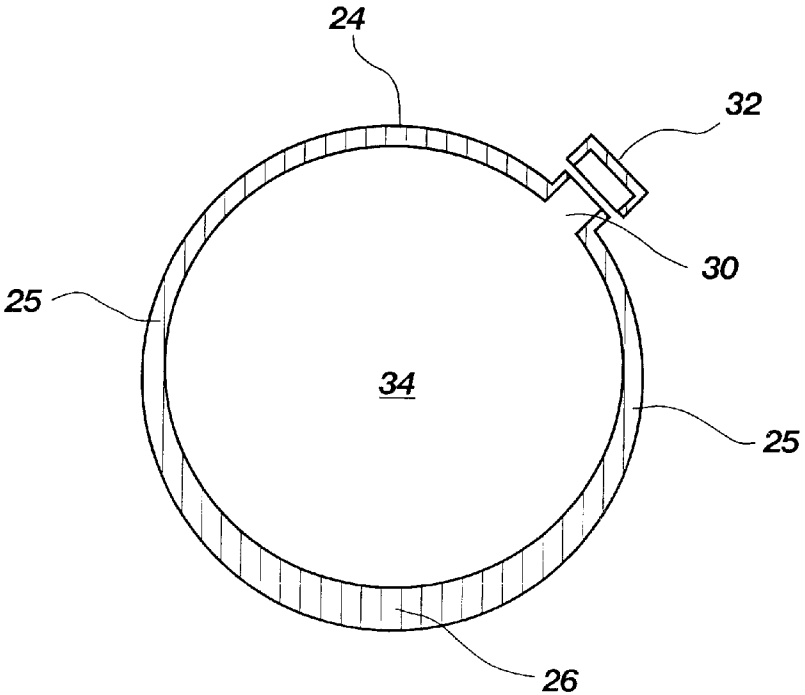
FIG. 2 is a cross sectional view of a pontoon constructed according to the present invention.

The pontoons may vary in thickness as shown in FIG. 2. In one embodiment, the pontoons may have a minimum thickness of 0.15 inch on the upper portion 24, and may be as thick as about 0.2 inch on the bottom portion 26. It will be apparent that these thicknesses may vary. For example, the maximum or minimum thicknesses may be increased or decreased from those values given. Also as shown in FIG. 2, the pontoons preferably can have a valve or air inlet/outlet 30, having a cap 32, which allows air to enter or leave the interior 34 of the pontoon.

The pontoons have shape memory characteristics because of their material and their shape. First, metalocene (one of the materials that can be used) is a thermoplastic material that can be formed into and caused to retain a given shape by heating. These shape memory characteristics provide many advantages. First, the pontoons are partially self-inflating. When it is desired to inflate the pontoons, the user simply removes the cap 32, and as the pontoon flexes to regain its normal inflated shape, air is drawn into the interior 34, causing the pontoon to substantially inflate itself. Additional air may then be pumped in to reach the desired inflation pressure.

It will be apparent that to deflate the pontoon, air is forced out through pressure. For example, when the filler cap 32 is removed, the air pressure within the pontoon will equalize with the atmosphere. Then, the user must press or flatten the pontoon as much as possible, and replace the cap. This prevents any air from entering, thus keeping the pontoon in the flattened or deflated shape.

Given the semi-rigid configuration, these pontoons are resistant to undesired deflation due to damage. First, the variation in thickness makes them more resistant to puncture on the bottom, where pontoons are most vulnerable. Second, the resilient nature of the polyolefin elastomer material tends to close any punctures naturally. For example, if a sharp object or knife blade punctures the surface, the resulting cut will tend to close upon itself and limit the rate of air escape. A very small puncture, such as from a fish hook, may entirely or almost entirely close, requiring no immediate repair. Third, when there is a puncture which allows air to escape, the semi rigid nature of the pontoons holds air within just by virtue of their shape. This allows the user adequate time to get to shore before the craft would otherwise sink. Even when severely punctured, the semi-rigid pontoons will hold air within, regardless of the location of the puncture. For example, if one were to have entirely removed the air filler cap from one pontoon of a two-pontoon craft while in use, as the pontoon deflates and begins to sink, one end or the other will remain higher, and will thereby trap a pocket of air within the damaged pontoon. Thus, while the craft will partially sink in a worst case scenario, it will still remain floating enough to aid the user in getting to safety.

The semi-rigid configuration of the pontoons also makes them less susceptible to pressure variations. The inventors have found that pressure variations of about ±6 psi have no significant effect on the shape of the pontoon. Consequently, if a pontoon is inflated at low altitude or when temperatures are low, the pontoon will keep its shape and not burst when ambient temperature increases or outside pressure drops significantly. This allows the pontoon to retain its full buoyancy in a much wider variety of conditions where thin membrane inflatables will vary widely in their performance, sometimes requiring periodic inflation or deflation or explosion.

Figure 3:
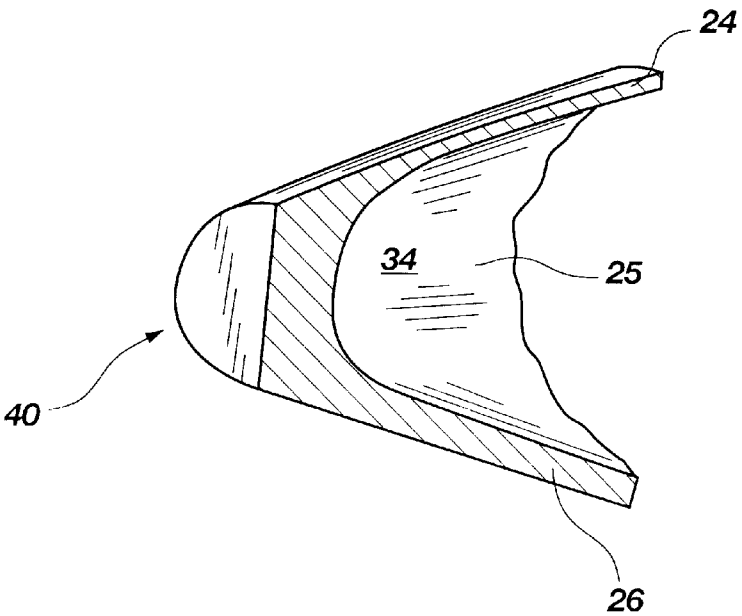
FIG. 3 is a cross sectional pictorial view of the nose portion of a pontoon constructed according to the present invention.

The shape memory of the pontoon material can also be aided by a rigid nose configuration. Referring to FIG. 1 and FIG. 3, the present invention can include a rigid nose 40 at each end of the pontoon. This nose 40 connects the top 24, bottom 26, and sides 25, and because of its geometry, tends to maintain the pontoon in its open, inflated shape. When the pontoon is deflated and flattened, the top 24, bottom 26, and sides 25 are placed in stress at the location where they are connected to the nose 40. This stress helps cause the top, bottom and sides to expand away from each other under internal stress when air is allowed to enter the interior of the pontoon.

The nose 40 is preferably thicker than the remainder of the pontoon, with the preferred thickness being about 0.3 inch or greater. This thickness not only provides desirable shape memory properties to the pontoon, but also makes the nose more resistant to damage from impact, etc., which is very likely for a pontoon.

The polyolefin elastomer material of the pontoons is also easier to repair than prior art pontoons. Because the polyolefin elastomer is a thermoplastic material, if the pontoon is cut or punctured, it may be repaired simply by applying heat. This may be done by simply pressing a hot knife or other item against the cut or puncture. The heat causes the polymer material to bond back together, usually resulting in a repair that is just as strong as the original undamaged material. Moreover, there is no need for unsightly patches, chemical adhesives, and the drawbacks that are associated with them. For additional repair strength, it is also possible to add more polyolefin material to the puncture during the heating repair process.

The pontoons are formed by a process known as rotational molding. In this process, the polymer material in the form of a powder is placed inside a mold. The mold is then heated as it is rotated, causing the powder to melt inside, and form the desired item. The thickness of the resulting product is controlled by regulating the temperature of various portions of the mold, with higher temperature areas producing a greater thickness than lower temperature areas.

In one embodiment, a self-inflating float for use with a pontoon boat can comprise a seamless, non-woven shell defining a cavity, wherein the shell is biased to form an expanded shape when pressure is equalized between the cavity and the air surrounding the shell; and a valve configured for allowing air in and air out of the cavity. Again, the shell can be constructed of a polyolefin elastomer, such as metalocene. In one embodiment, the shell can further comprise an upper portion having a first thickness and a lower portion having a second thickness. Preferably, the first thickness is less than the second thickness, though this is not required. Also preferably, a nose portion is present having a third thickness that is thicker than the first thickness and the second thickness. In this and other configurations, negative pressure can be applied to the cavity through the valve to completely deflate the float. Alternatively, positive pressure can be applied to the cavity through the valve to increase the rigidity of the float.

One skilled in the art of portable pontoon boats will appreciate the design of the preferred embodiments. For example, although variable thickness is illustrated, having uniform thick walls is also contemplated and can still retain the same advantages as the variable thickness design.

Although the carryable pontoon boat is described to be made of a polyolefin elastomer, other materials exhibiting similar capabilities will be readably substitutable. For example, any middle weight carbon polymer material, particularly unsaturated thermoplastics, typically having carbon chains of 18–24 can form the basic polymeric unit.

Although the currently illustrated embodiments of the invention illustrate a pontoon boat with two floats on either side of a seat, the same design will work for other inflatable boats. For example, circular float tubes, u-shaped float tubes, inflatable canoes, or inflatable rafts could all use the teaching of the current application.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A hand portable inflatable boat for floating a person in water, comprising:

a) a seat, positioned to support a person on the boat; and b) at least one float, positioned to support the seat above the water, having:

i) a cavity formed within the float, designed to hold air; and ii) a wall, formed around the cavity, that has a shape memory in a form of a fully inflated float, wherein the wall substantially retains its inflated shape after being punctured and while at least partially submerged.

2. The boat of claim 1, wherein the wall is a unified body that has no seams.

3. The boat of claim 1, wherein a bottom wall thickness of the float is thicker than a top wall thickness of the float.

4. The boat of claim 3, wherein the top is about 0.15 inch thick and the bottom is about 0.2 inch thick.

5. The boat of claim 4, wherein the float has an end portion that has a thickness that is thicker than other portions of the wall.

6. The boat of claim 5, wherein the end portion is approximately 0.3 inch thick.

7. The boat of claim 1, wherein the float has an end portion that has a thickness that is thicker than other portions of the wall.

8. The boat of claim 1, wherein the wall is designed to be punctured and substantially retain the air within the cavity.

9. The boat of claim 1, wherein the float is configured to entrap air in the end portions when becoming deflated, to thereby resist complete deflation.

10. The boat of claim 1, wherein the float is formed by rotational molding.

11. The boat of claim 1, wherein the float is formed of a polyolefin elastomer, commonly known as metalocene.

12. The boat of claim 1, wherein the float self-inflates at least 40%.

13. The boat of claim 1, wherein punctures in the float may be eliminated by applying heat to the polymer material at the site of the puncture so as to fuse the polymer material together.

14. The boat of claim 1, wherein the float walls can withstand relative pressure changes without substantial change in the shape thereof.

15. The boat of claim 14, wherein the float walls will allow pressure changes of plus and minus of about 6 psi.

16. A hand portable inflatable boat for floating a person in water, comprising:

a) a seat, positioned to support a person on the boat; and b) at least one float, positioned to support the seat above the water, having:

i) a cavity formed within the float, designed to hold air; and ii) a wall, formed around the cavity, that has a shape memory in a form of a fully inflated float, said wall having a bottom wall thickness that is thicker than a top wall thickness of the float, and wherein the float is configured to entrap air in the end portions when becoming deflated, to thereby resist complete deflation.

17. A hand portable inflatable pontoon boat for floating a person in water, comprising:

a) a seamless, non-woven, one-piece, inflatable vessel of resilient, semi-rigid polyolefin elastomer, having a top, a bottom and two ends which taper to a blunt point that is thicker than other portions thereof, wherein the vessel is configured to retain a shape memory of an inflated configuration, so as to be partially self-inflating and configured to entrap air when partially deflated, to thereby resist complete deflation; and b) a seat, positioned on the vessel, said seat configured to support a person.

18. The pontoon of claim 17, wherein the bottom of the pontoon is thicker than the top.

19. The pontoon of claim 17, wherein the pontoon is formed by rotational molding.

20. The pontoon of claim 19, wherein the pontoon is tolerant of relative pressure changes without substantial deformation or change in the shape thereof.

21. A self-inflating float for use with a pontoon boat, comprising:

a) a seamless, non-woven shell defining a cavity, said shell being biased to form an expanded shape when pressure is equalized between the cavity and the air surrounding the shell, and wherein the wall is designed to be punctured and substantially retain the air within the cavity; and b) a valve configured for allowing air in and air out of the cavity.

22. A self-inflating float as in claim 21 wherein the shell is constructed of a polyolefin elastomer.

23. A self-inflating float as in claim 21 wherein the shell further comprises an upper portion having a first thickness and a lower portion having a second thickness.

24. A self-inflating float as in claim 23 wherein the first thickness is less than the second thickness.

25. A self-inflating float as in claim 24 further comprising a nose portion, said nose portion having a third thickness that is thicker than the first thickness and the second thickness.

26. A self-inflating float as in claim 21 wherein negative pressure applied to the cavity through the valve is required to completely deflate the float.

27. A self-inflating float as in claim 21 wherein positive pressure applied to the cavity through the valve is used to increase the rigidity of the float.

28. A hand portable inflatable boat for floating a person in water, comprising:

a) a seat, positioned to support a person on the boat; and b) at least one float, positioned to support the seat above the water, having:

i) a cavity formed within the float, designed to hold air; and ii) a wall, formed around the cavity, that has a shape memory in a form of a fully inflated float, wherein the wall is designed to be punctured and substantially retain the air within the cavity.

29. The boat of claim 28, wherein punctures in the float may be eliminated by applying heat to the polymer material at the site of the puncture so as to fuse the polymer material together.

30. The boat of claim 28, wherein the wall substantially retains its inflated shape after being punctured and while at least partially submerged.

31. The boat of claim 28, wherein the wall is a unified body that has no seams.

32. The boat of claim 28, wherein a bottom wall thickness of the float is thicker than a top wall thickness of the float.

33. The boat of claim 32, wherein the top is about 0.15 inch thick and the bottom is about 0.2 inch thick.

34. The boat of claim 28, wherein the float has an end portion that has a thickness that is thicker than other portions of the wall.

35. The boat of claim 28, wherein the float has an end portion that has a thickness that is thicker than other portions of the wall.

36. The boat of claim 28, wherein the end portion is approximately 0.3 inch thick.

37. The boat of claim 28, wherein the float is formed by rotational molding.

38. The boat of claim 28, wherein the float is formed of a polyolefin elastomer, commonly known as metalocene.

39. The boat of claim 28, wherein the float self-inflates at least 40%.

40. The boat of claim 28, wherein the float is configured to entrap air in the end portions when becoming deflated, to thereby resist complete deflation.

41. The boat of claim 28, wherein the float walls can withstand relative pressure changes without substantial change in the shape thereof.

42. The boat of claim 41, wherein the float walls will allow pressure changes of plus and minus of about 6 psi.

* * * * *